US006098416A

United States Patent [19]

Addington et al.

[11] Patent Number: 6,098,416

[45] Date of Patent: Aug. 8, 2000

[54] HEAT PUMP, HOUSING AND METHOD

[75] Inventors: Robert R. Addington, Lexington; Bobby G. Newsom, Virgie, both of Ky.

[73] Assignee: Friedrich Air Conditioning Co., San Antonio, Tex.

[21] Appl. No.: 09/208,876

[22] Filed: Dec. 10, 1998

[51] Int. Cl.[7] ..... F25D 19/00

[52] U.S. Cl. ..... 62/298; 62/263; 62/259.1

[58] Field of Search ..... 62/263, 298, 259.1

[56] References Cited

U.S. PATENT DOCUMENTS

| | | | |
|---|---|---|---|
| 2,690,654 | 10/1954 | Graham . | |
| 2,817,217 | 12/1957 | Winkler et al. | 62/129 |
| 3,097,506 | 7/1963 | Blakesley | 62/263 |
| 3,267,995 | 8/1966 | Maudlin et al. . | |
| 3,583,175 | 6/1971 | Eubank | 62/326 |
| 4,424,686 | 1/1984 | Lapeyre et al. | 62/259.1 |
| 4,458,502 | 7/1984 | Adachi et al. | 62/259.1 |
| 4,554,796 | 11/1985 | Stankard | 62/326 |
| 4,598,558 | 7/1986 | Bingham | 62/324.1 |
| 4,644,759 | 2/1987 | Bingham | 62/324.1 |
| 5,140,830 | 8/1992 | Sawyer | 62/298 |
| 5,187,950 | 2/1993 | Weldon | 62/449 |
| 5,191,770 | 3/1993 | Kim | 62/263 |
| 5,197,299 | 3/1993 | Sohn et al. | 62/262 |
| 5,271,242 | 12/1993 | Addington | 62/285 |
| 5,388,426 | 2/1995 | Wanda et al. | 62/263 |
| 5,533,346 | 7/1996 | Freeman et al. | 62/89 |
| 5,687,581 | 11/1997 | Price | 62/263 |
| 5,697,226 | 12/1997 | Marchesi | 62/263 |
| 5,755,109 | 5/1998 | Kim | 62/259.1 |
| 5,775,408 | 7/1998 | Shimek et al. | 165/48.1 |
| 5,857,353 | 1/1999 | Schneider et al. | 62/404 |

*Primary Examiner*—William Doerrler
*Assistant Examiner*—Mark Shulman
*Attorney, Agent, or Firm*—Gunn, Lee & Keeling

[57] ABSTRACT

A heat pump housing made from plastic is disclosed herein. The housing is preferably two-piece including a wall plate and a shell. The wall plate may be secured to conventional wall studs and provides outside air intake and exhaust openings. The wall plate additionally provides supports for the temporary support of the shell while the shell is being secured to the wall plate. The shell includes chambers for conditioned and unconditioned air, a removable drain shelf separating the two; and shelves for support of the compressor, blowers and other conventional heat pump features.

17 Claims, 9 Drawing Sheets

HEAT PUMP, HOUSING AND METHOD

BACKGROUND OF THE INVENTION

1. Field of the Invention

This invention pertains to a wall mounted, plastic heat pump housing for use in small rooms or suites.

2. Description of the Prior Art and Objectives of the Invention

As hotels and studio apartments have proliferated, there has been a need felt by the HVAC community for a small heating and cooling unit which can handle small volumes of air independently of similarly situated rooms, suites or apartments. Some solutions were seen in window mounted air conditioners, but these failed to provide means to heat the space. Electric space heaters provided another half solution.

Another concern in the creation of a solution to the problem is the availability of space. In a studio apartment, space is typically a premium, as in a hotel suite or room. Therefore, any solution must also be space efficient and include both heating and cooling modes.

While conventional heat pumps allow the heating and cooling functions desired, most are bulky, weighty or otherwise undesirable. Most conventional heat pumps typically require extensive installation, and two or more installers. Additionally, most heat pumps are housed in a fabricated metal housing which may have sharp edges and require additional insulation to function properly.

With the above concerns in mind, it is an objective of the present invention to provide a wall mounted heat pump which is space efficient.

It is a further objective of the present invention to provide a heat pump with a plastic structural foam housing to eliminate the need for extra insulation and to reduce weight.

It is still a further objective of the present invention to provide a heat pump which is well suited for one ton or less of atmospheric conditioning.

It is another objective to provide a method of installing a heat pump by an individual in a simple, time effective manner.

It is still another objective to provide a heat pump which is easily adaptable to a number of different installation configurations.

These and other objectives and advantages will become readily apparent to those skilled in the art upon reference to the following detailed description and accompanying drawing figures.

SUMMARY OF THE INVENTION

The aforesaid objectives and advantages are realized by providing a heat pump having a two-piece plastic molded housing wherein the first piece is a wall plate and the second piece is a molded shell. Both are preferably made from polycarbonate or polyvinyl chloride (PVC) foam but other polymeric materials are acceptable. PVC is especially preferred since it provides several advantages, namely it is relatively strong; insulates well; may be any shape or color; and provides good sound deadening qualities. The wall plate is generally planar but comprises a pair of lips or ridges, the inner of which is "taller" than the other, both of which circumnavigate the perimeter. Disposed between these two ridges is a standard o-ring. Additionally, the wall plate comprises an arcuate bulge or recess extending from the rear face and a pair of supports extend from the front face. The wall plate defines a series of apertures which allow mounting on the interior surface of an exterior room wall. The wall plate further includes an outside air intake and an outside air exhaust opening.

The shell defines two side panel access openings, an air intake and an air exhaust opening. A rearward edge is sized to fit within the two ridges or lips of the wall plate for sealing engagement with the o-ring. The first side access opening communicates with a utility chamber including a drain trap so that algicide or the like can be added. The second side access opening provides access to the electrical controls. The shell also includes shelves for compartmentalizing the various blowers, compressor and heat coils. A removable shelf defines an upper chamber for conditioned air and separates the same from the unconditioned air compartment while at the same time providing a drain for the upper conditioned air chamber. Ribs on the bottom of the removable shelf allow for blower mounting.

Additionally, the heat pump may be positioned in a closet or the like with alternative intakes and exhausts for space conservation as needed.

DETAILED DESCRIPTION OF THE PREFERRED EMBODIMENTS AND OPERATION OF THE INVENTION

Figure 1:
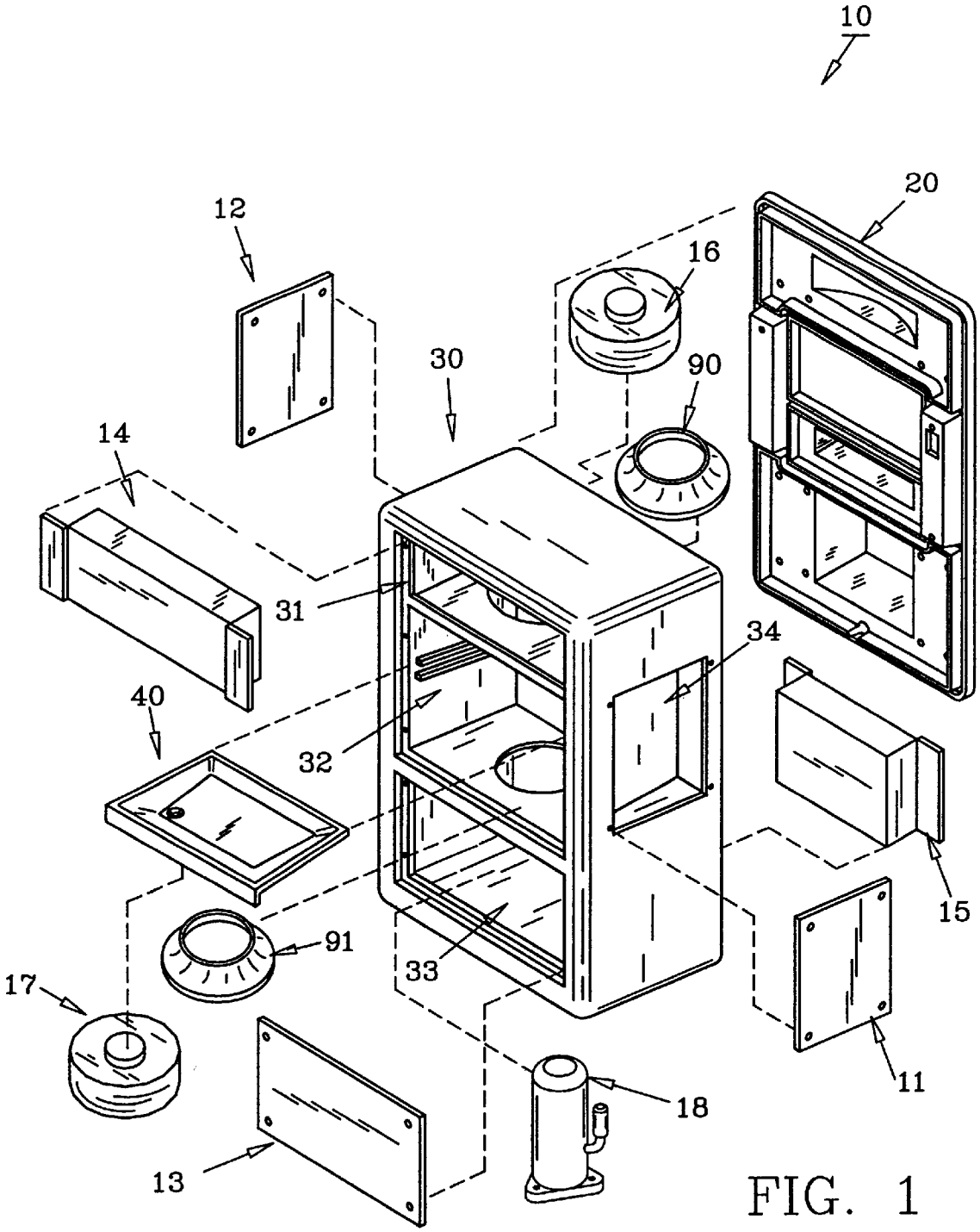
FIG. 1 shows an exploded perspective view of certain of the components of the preferred heat pump and housing of the present invention.

Turning now to the drawings, specifically FIG. 1 shows exploded heat pump 10, which comprises housing wall plate 20, shell 30, side access panels 11 and 12, front access panel 13, front coil 14, back coil 15, removable shelf 40, blowers 16 and 17, inlet rings 90 and 91 and compressor 18. Conventional centrifugal fan, namely first blower 16 is positioned in first or upper chamber 31 to process conditioned air while second blower 17 is mounted in second or lower chamber 32 to process unconditioned air. Compressor 18 is located in third or lowest chamber 33. Side access panels 11 and 12 allow access to electrical chamber 34 and utility chamber 35 (FIG. 3) respectively. Access panels 11–13 and coils 14 and 15 are held on shell 30 by conventional fasteners such as screws, bolts or rivets, although selectively removable fasteners like bolts are preferred. Additional conventional electrical circuitry, refrigerant tubes, plumbing connections and the like are not shown, but well understood in the heat pump industry, for example a conventional drain trap may be located in utility chamber 35. Entry to such a drain trap would be allowed through aperture 12' (FIG. 3) so that a user could insert conventional algicides into the drain trap.

Figure 2:
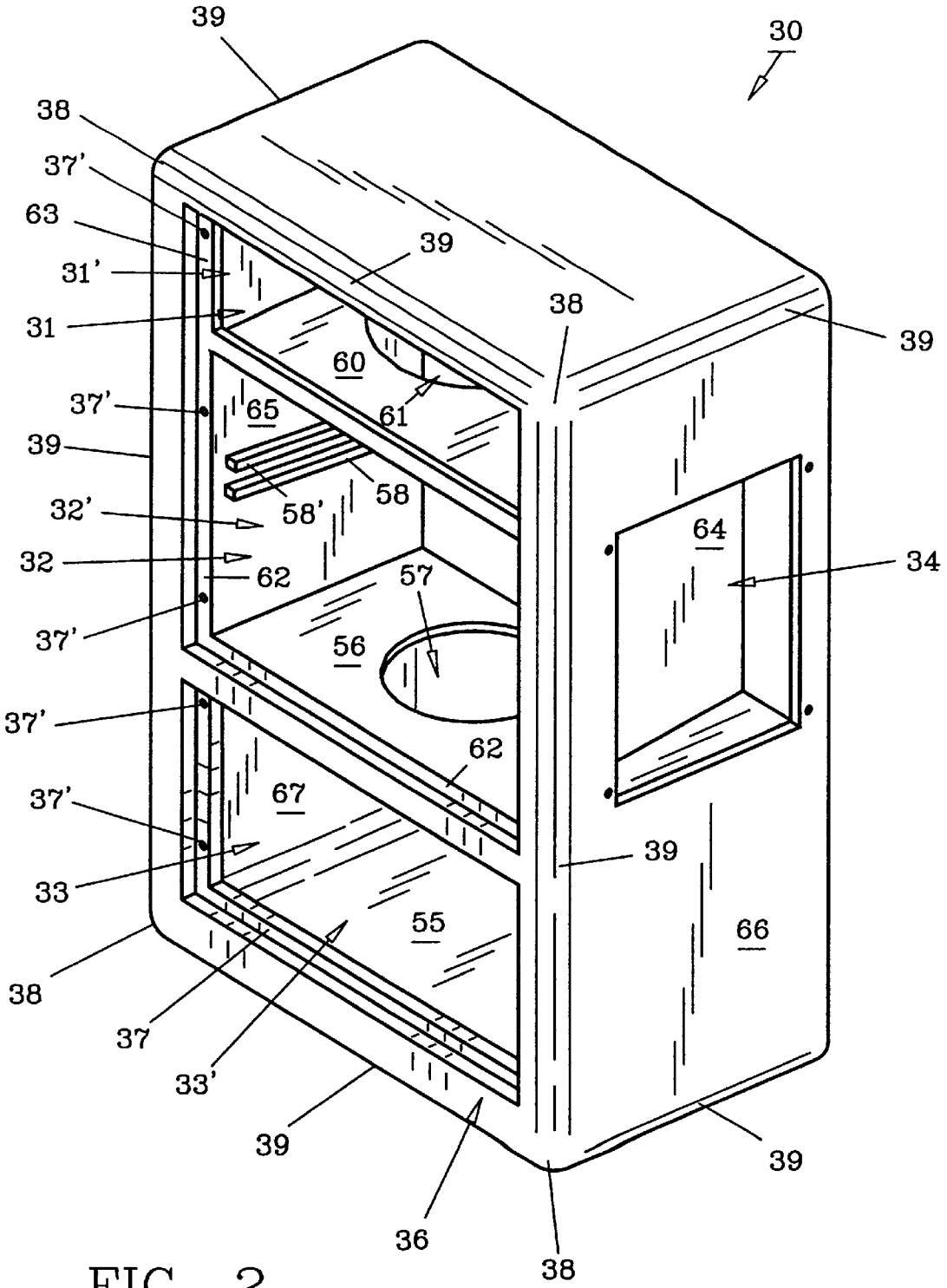
FIG. 2 illustrates an enlarged perspective front top side view of the housing shell.
Figure 3:
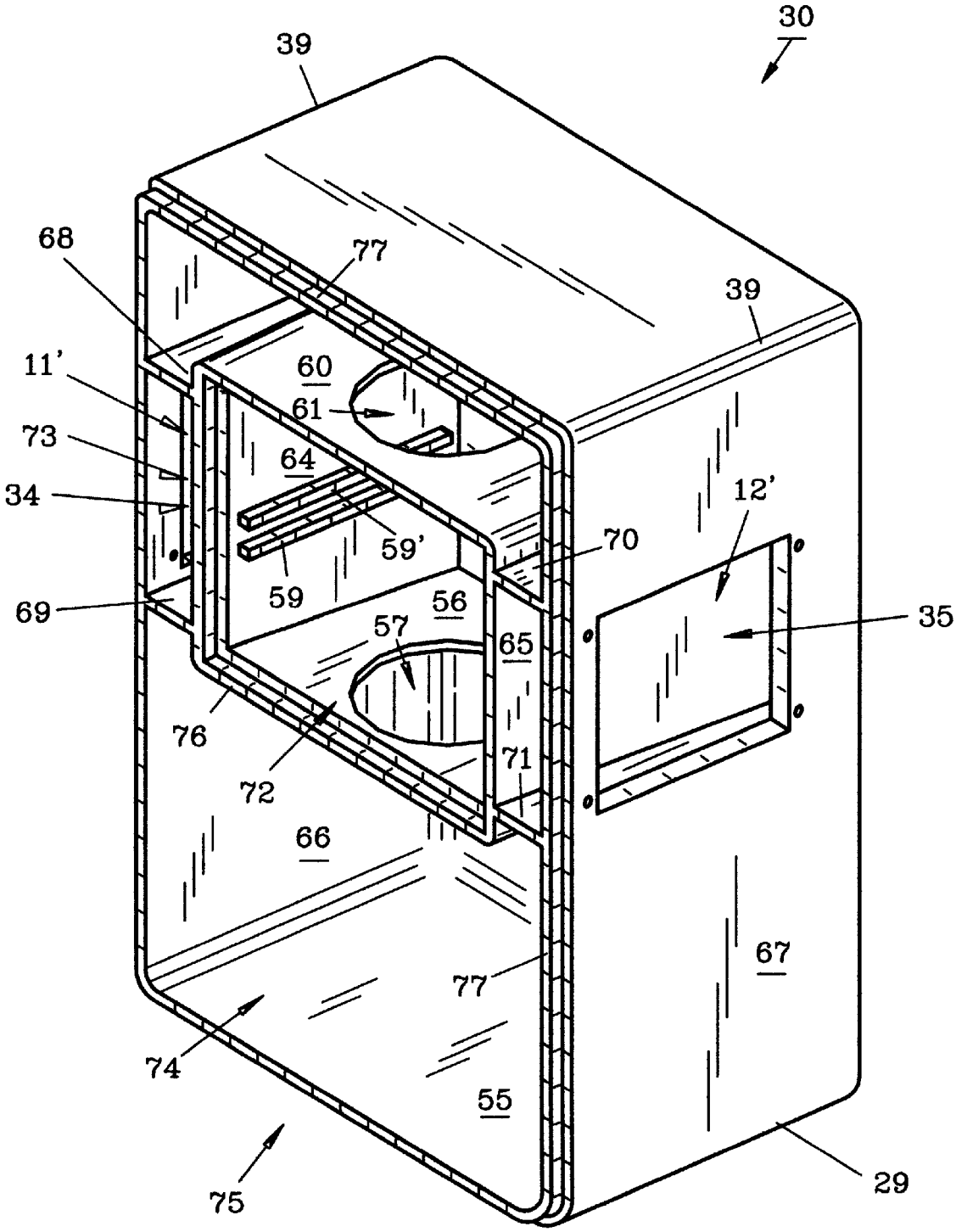
FIG. 3 demonstrates an enlarged perspective rear view of the shell of FIG. 2.

FIGS. 2 and 3 show enlarged views of shell 30 which is preferably a single molded polymeric unit. Corners 38 and edges 39 are preferably rounded for molding and aesthetic reasons. Front surface 36 defines aperture 33' which opens into lowest chamber 33. Aperture 33' includes shoulder 37 which surrounds the perimeter of aperture 33' and provides a base for screw apertures 37'. Shoulder 37 is recessed from front surface 36. Floor 55 is seen through aperture 33' and provides support for compressor 18 (FIG. 1).

Floor 56 separates second chamber 32 from third chamber 33, but defines circular aperture 57 which receives second inlet ring 91 (first inlet ring 90 is discussed below) therein. Ribs 58, 58', 59 and 59' (FIGS. 2 and 3) comprise horizontal, parallel ridges which receive removable tray 40 therebetween. Thus, when removable tray 40 is inserted, second chamber 32 is divided. Second chamber 32 is reached by aperture 32'. Surrounding aperture 32' is shoulder 62 which accepts a front grill and filter (not shown). An air intake (not shown) is located below floor 60 and above ribs 58, 58', 59 and 59'.

Floor 60 separates first chamber 31 from second chamber 32, and defines circular aperture 61 which receives first inlet ring 90 therein. First chamber 31 is entered through aperture 31' which acts as a conditioned air outlet. Surrounding aperture 31' is shoulder 63. A conventional vent or grate (not shown) may cover aperture 31'.

As better seen in FIG. 3, sidewalls 64 and 65 of second chamber 32 are spaced from sidewalls 66 and 67 respectively of shell 30, thus creating space for electrical chamber 34 and utility chamber 35. Chamber 34 is further delimited by ceiling 68 and floor 69, while chamber 35 is similarly delimited by ceiling 70 and floor 71. While not shown, electrical chamber 34 houses the electrical wires, connections and power input for heat pump 10. Chambers 34 and 35 are larger than respective apertures 11' and 12' thus forming a lip on the exterior wall of each chamber. Rear face 75 of shell 30 is generally open but specifically defines apertures 72–74 which open into second chamber 32, electrical chamber 34 and utility chamber 35 respectively. Aperture 72 is surrounded by shoulder 76 which is similar to shoulder 62.

Figure 4:
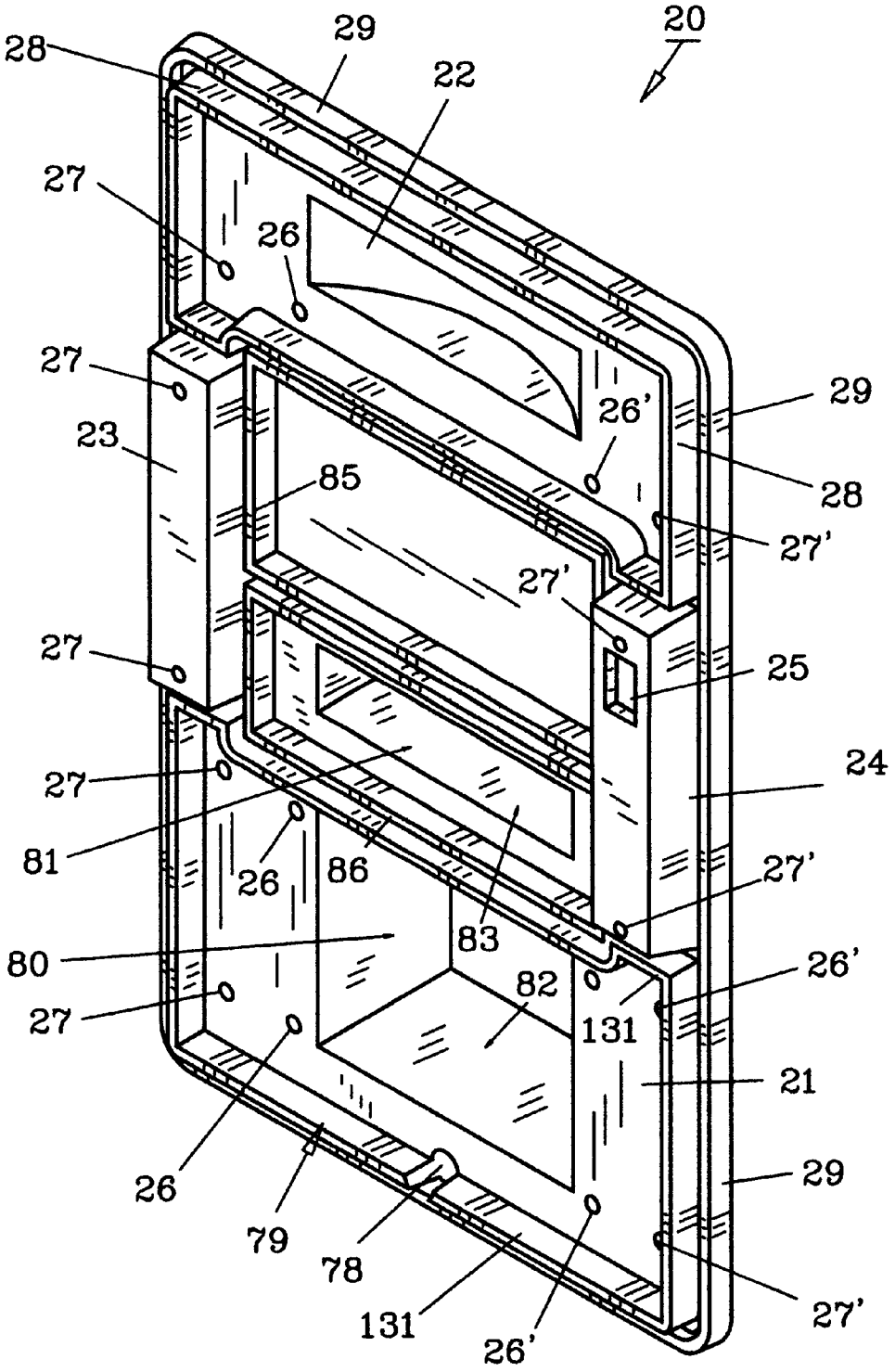
FIG. 4 features an enlarged perspective front view of the wall plate.

FIG. 4 illustrates wall plate 20 which comprises generally planar mount 21. Mount 21 defines indented mounting perforations 26, 26' and 27, 27', wherein perforations 26, 26' are spaced for mounting on 16" stud spacing. Perforations 27, 27' are spaced for mounting on 24" stud spacing. Mount 21 includes generally arcuate or semi-circular recess 22 which is configured to allow air circulation around first blower 16 (FIG. 1). Mount 21 also includes supports 23 and 24, with support 23 generally contiguous utility chamber 35 and support 24 generally contiguous electrical chamber 34 in use. Positioned in support 24 is an electrical box (not shown) which receives conventional wiring and provides a female receptacle, not shown, but flush with aperture 25 defined by support 24, for providing power to heat pump 10. A male plug (not shown) extends from electrical chamber 34 to aperture 25 mate with the female receptacle and provide power to heat pump 10. Mount 21 includes lip 29 which extends uniformly around the entire perimeter of mount 21. Proximate the top edge of mount 21 is interior lip 28 which is "taller" than lip 29 and proximate thereto. Beneath lip 28 is lip 85 and lip 86, which are both generally rectangular and positioned between supports 23 and 24, while being spaced slightly therefrom. Proximate bottom edge 79 of mount 21 is interior lip 131, similar to lip 28 and taller than lip 29. Lips 28, 131 and 29 help form a tight seal with shell 30, and a generally rectangular o-ring (not shown) may be positioned within the perimeter formed by lip 29, so that the o-ring lies between lip 28 and lip 29, between lip 131 and lip 29, between support 23 and lip 29, and between support 24 and lip 29. Edge 77, which surrounds rear face 75 of shell 30 (FIG. 3) fits against the o-ring and between lip 28 and lip 29, between lip 131 and lip 29, between support 23 and lip 29, and between support 24 and lip 29 to effectuate a good seal. Proximate bottom edge 79 of wall plate 20, mount 21 defines drain aperture 78, which is connected to conventional drain plumbing (not shown) for removal of condensate as may collect within heat pump 10. Mount 21 defines outside air intake 80 and outside air exhaust 81, which are both generally rectangular and further comprise sleeves 82 and 83 respectively. Lips 85 and 86 engage shoulder 76 of shell 30 for additional sealing purposes, and an o-ring (not shown) may also be used for further sealing.

Figure 5:
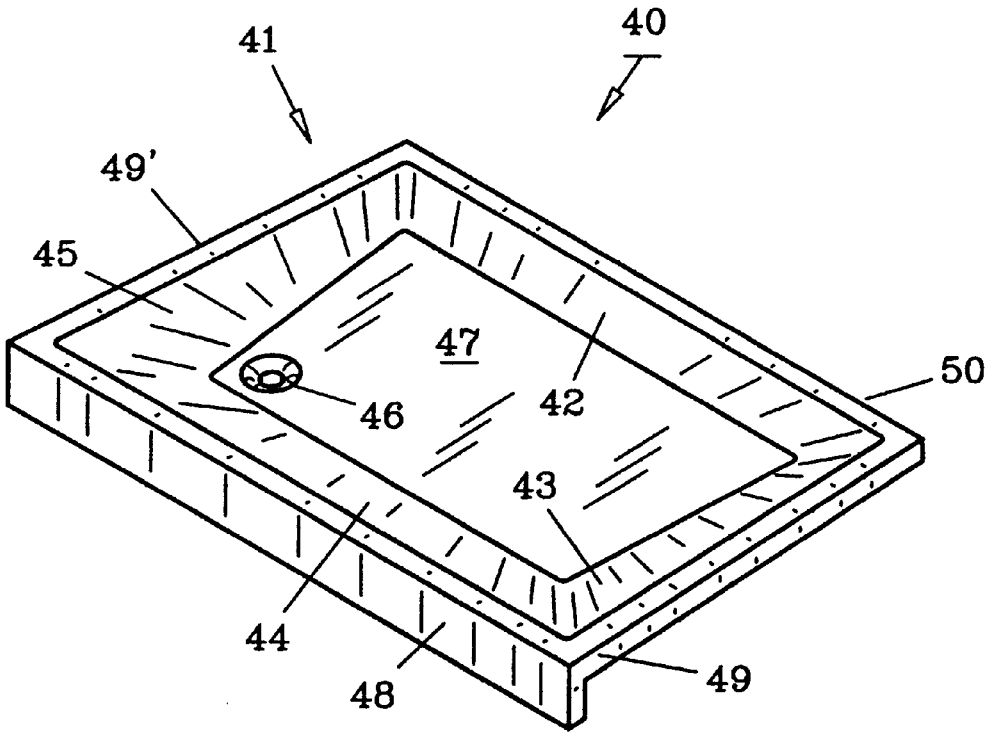
FIG. 5 pictures an enlarged top front perspective view of the removable shelf.
Figure 6:
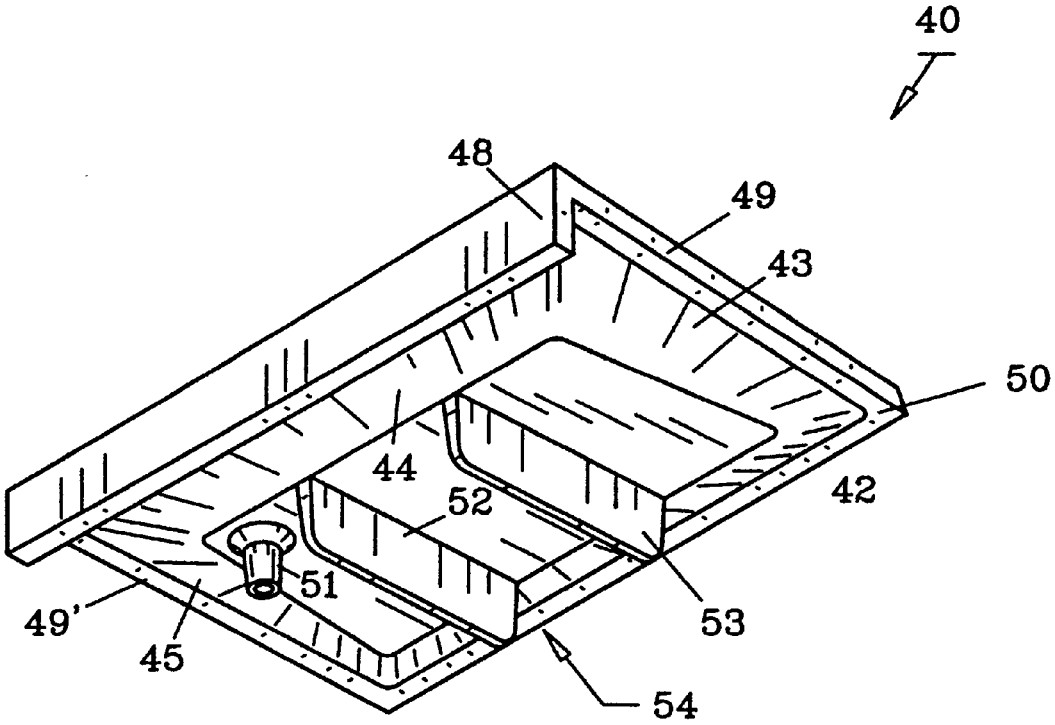
FIG. 6 depicts an enlarged bottom front perspective view of the shelf of FIG. 5.

FIGS. 5 and 6 demonstrate enlarged views of removable shelf 40. Specifically, FIG. 5 shows top 41 of shelf 40. Top 41 has sloped sides 42–45. Drain 46 is positioned on floor 47 of shelf 40 and sides 42–45 slope to floor 47 while floor 47 slopes towards drain 46 for proper draining thereof. Shelf 40 also includes front lip 48, side edges 49, 49' and back lip 50. Side edges 49, 49' slide within the channels formed by ribs 58, 58', 59 and 59' while front lip 48 prevents over-insertion of shelf 40 into shell 30. As seen in FIG. 6, bottom 54 of shelf 30 includes drain nozzle 51 and ridges 52 and 53, which allow mounting of second blower 17 thereon.

Figure 10:
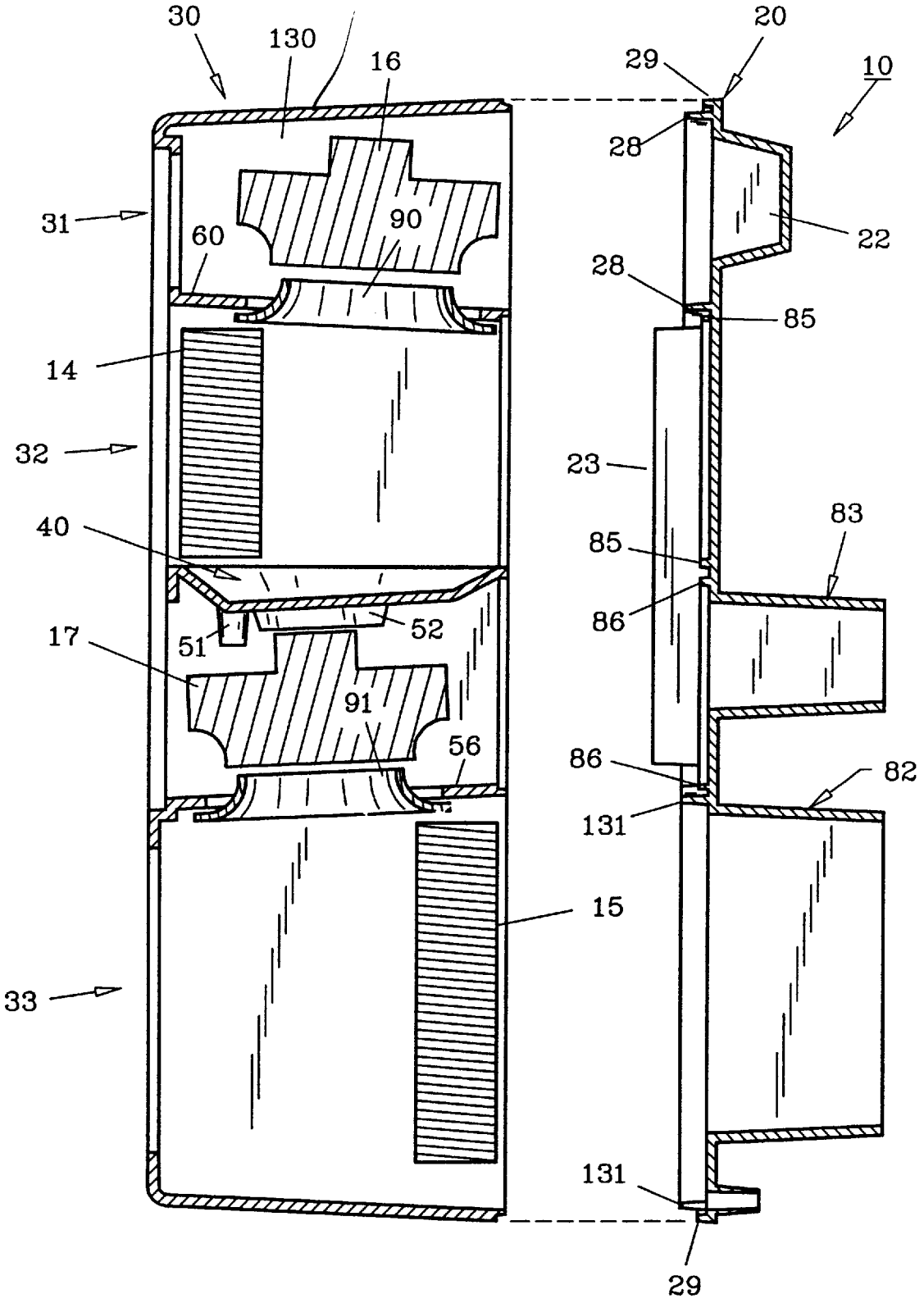
FIG. 10 features a cross-sectional view of the heat pump of the present invention.

A cross-sectional view of assembled heat pump 10 is presented in FIG. 10. Shell 30 sealingly engages wall plate 20, although the two are spaced for clarity in this view. First blower 16 is attached to roof 130 of shell 30. Inlet ring 90 is positioned in floor 60 with a slight space between blower 16 and ring 90. Air enters through coil 14, passes through inlet ring 90, is circulated by blower 16 and exits aperture 31. Similarly, second blower 17 is attached to removable drain shelf 40 and spaced slightly from inlet ring 91, which is positioned in floor 56. Unconditioned or outside air enters through sleeve 82, passes through coil 15, thence through inlet ring 91 for circulation by blower 17 and then out sleeve 83 for proper exhaust. Note that some features have been omitted for clarity in explaining those features presented. For example, electrical chamber 34 is positioned behind coil 14 while blower 17 and compressor 18 are proximate coil 15.

The preferred method of assembling and mounting heat pump 10 comprises selecting an exterior wall (not shown) such as is commonly found in hotel rooms. Wall plate 20 is affixed on the interior surface of the wall using either perforations 26, 26' or 27, 27' (FIG. 4) as needed using conventional fasteners (not shown). Sleeves 82 and 83 should extend through the wall for access to outside air. Furthermore, a recess is first made in the wall to accommodate arcuate bulge 22. Electrical connections (not shown) are brought to aperture 25. Plumbing connections (not shown) are then attached to drain aperture 78.

With wall plate 20 so positioned on the wall, one individual may manually lift and temporarily rest shell 30 (FIG. 3), particularly ceilings 68 and 70, on supports 24 and 23 respectively (FIG. 4). Rearward edge 77 (FIG. 3) is inserted between lip 29 and lips 28 and 131 and supports 23 and 24 to engage the o-ring (not shown). Taller lips 28 and 131 help guide rearward edge 77 into place. Likewise, shoulder 76 is guided into position between lips 85 and 86. Supports 23 and 24 will temporarily hold shell 30 in the desired posture while the installer rigidly affixes shell 30 to wall plate 20 with conventional fasteners (not shown). Shelf 40 is then inserted into the channels formed by ribs 58, 58', 59, and 59'. Preferably, blowers 16, 17 and compressor 18 are already positioned in shell 30. Since shell 30 is made of plastic and is relatively small, it is possible for one individual to complete the installation without assistance. After insertion of shelf 40, conventional filters are positioned over air intake aperture 32. Electrical chamber 34 and utility chamber 35 are covered by access panels 11 and 12 respectively after the appropriate connections are made. Bottom front panel 13 is then positioned over aperture 33', and a conventional grill (not shown) is positioned over conditioned air return aperture 31'. This procedure effectively creates the preferred mounting of heat pump 10 wherein conditioned air directly enters coil 14 and exits top chamber 31 after further conditioning. Unconditioned outside air passes through back coil 15 and exits through the wall. No additional duct work is required and installation is relatively simple.

Figure 7:
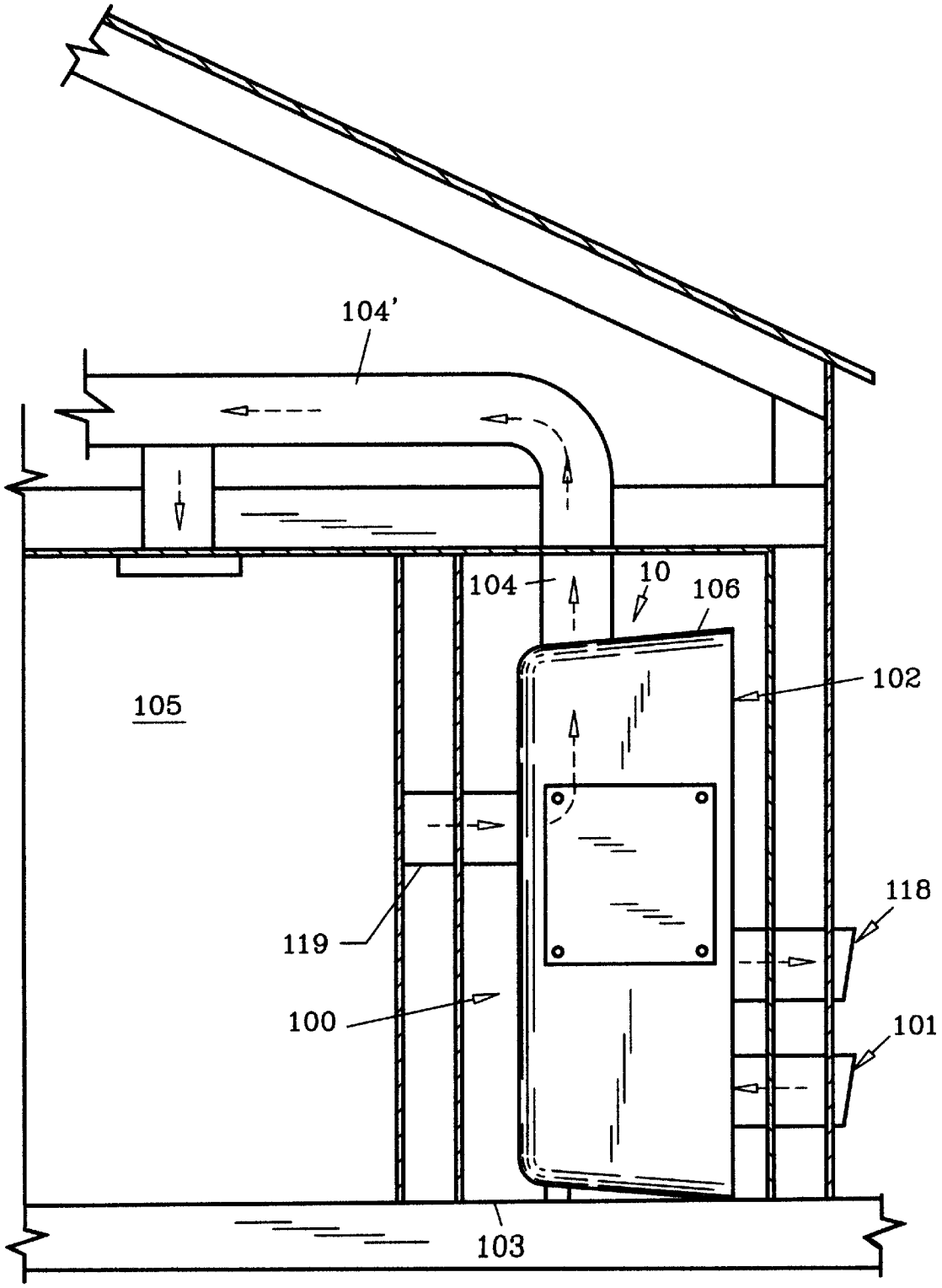
FIG. 7 shows the heat pump of FIG. 1 as installed in a closet with an upward air flow.
Figure 8:
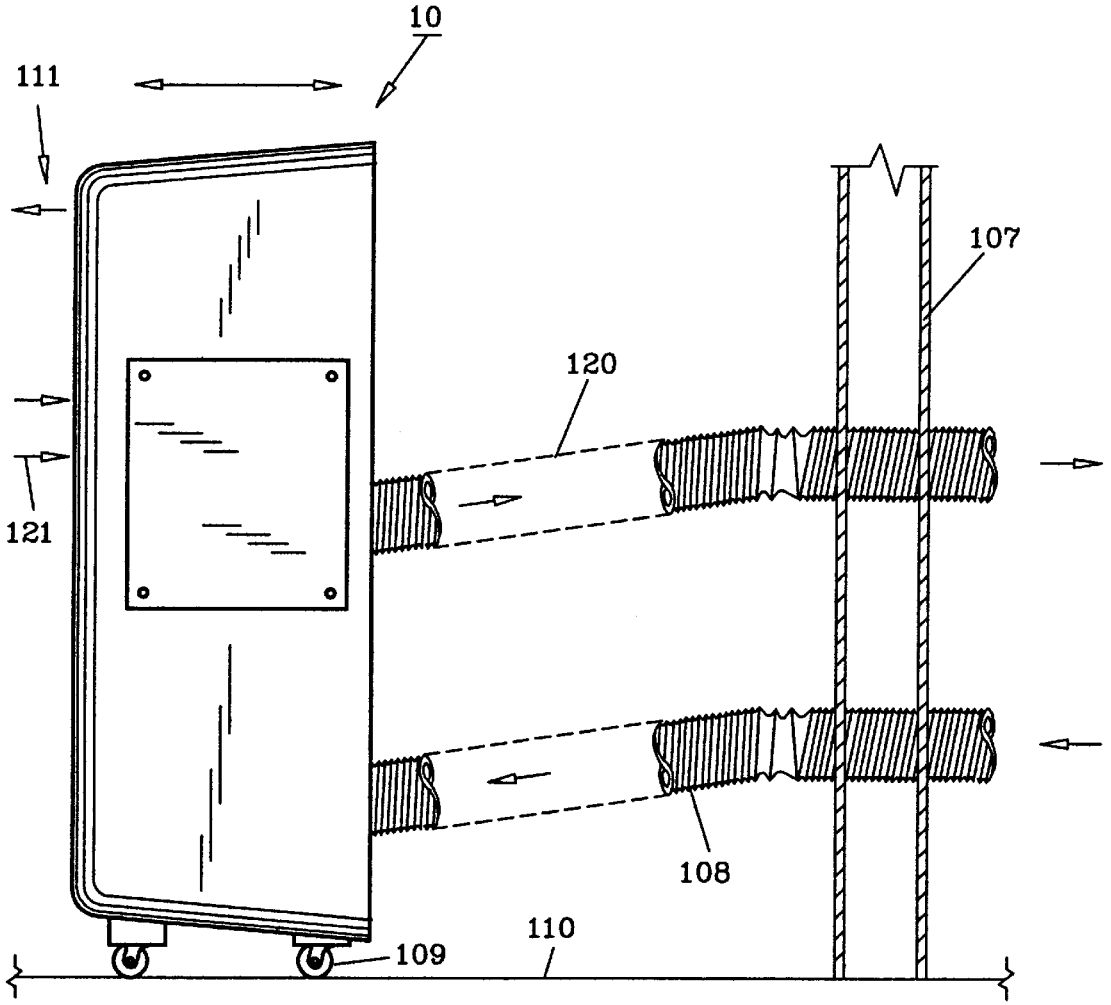
FIG. 8 illustrates the heat pump of FIG. 1 mounted on rollers and connected to an exterior wall by flexible conduits.
Figure 9:
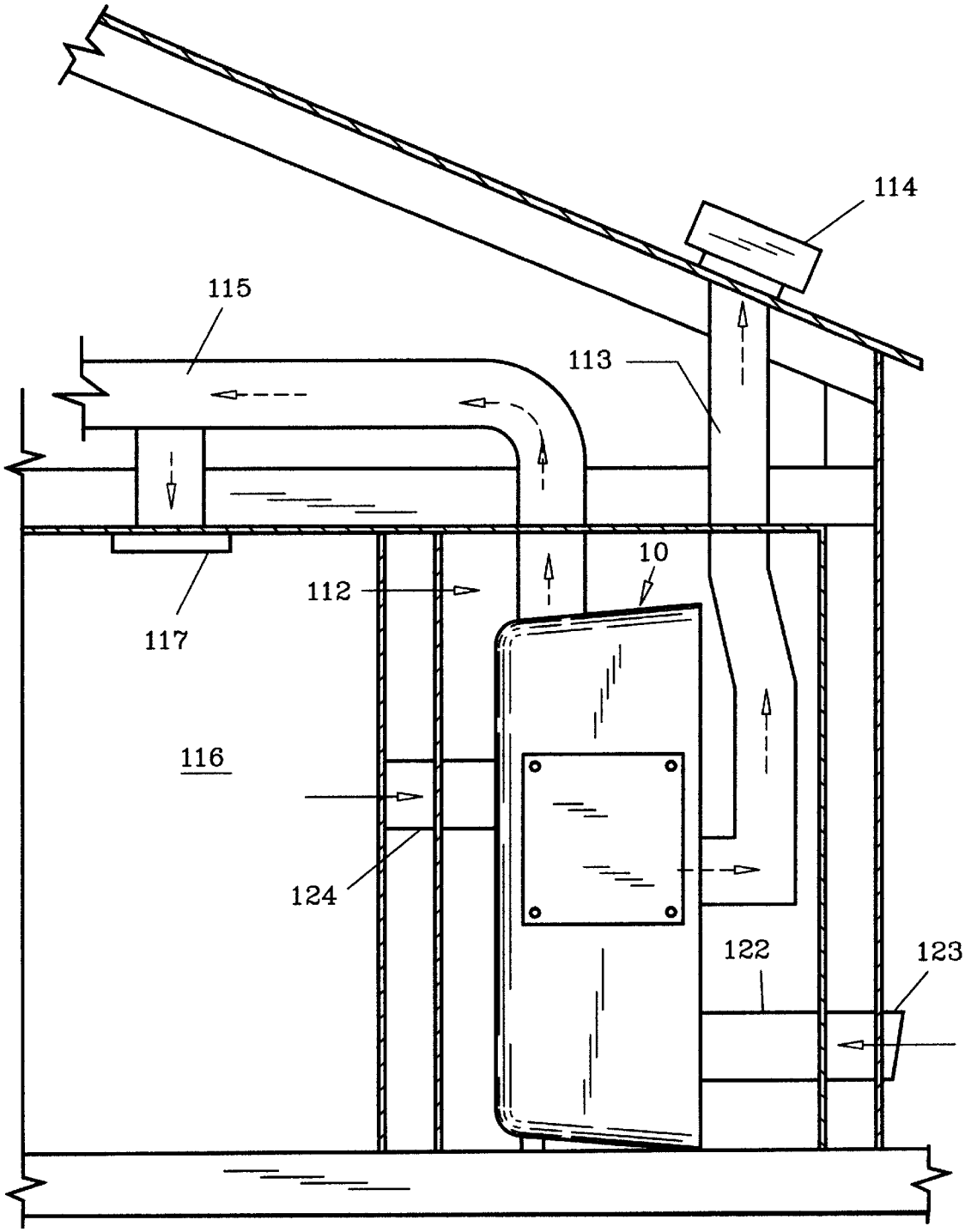
FIG. 9 demonstrates a third configuration of the heat pump of FIG. 1.

While the above is preferred, alternative placement and venting of heat pump 10 is possible as seen in FIGS. 7–9. Specifically, as seen in FIG. 7, heat pump 10 may be placed in a closet or similar enclosed space 100 with duct 101 providing external air intake and duct 118 providing external exhaust to rear 102 of heat pump 10. In this embodiment, heat pump 10 rests on floor 103 and conditioned air travels in through duct work 119 to heat pump 10 and out through duct work 104 to conditioned room 105. Duct work 104 extends upwardly from top 106 and may include horizontal duct work 104' positioned in an attic or the like.

In contrast, FIG. 8 shows heat pump 10 attached to exterior wall 107 by flexible, compressible duct work 108 and 120. Heat pump 10 is positioned on rollers 109 which allows selective positioning on floor 110. Since duct work 108 and 120 are flexible and compressible, heat pump 10 may be proximate or contiguous wall 107 or spaced as shown. Conditioned air is directly pumped out of heat pump 10 as generally indicated by arrow 111 while entering heat pump 10 as generally indicated by arrow 121.

Also, as seen in FIG. 9, heat pump 10 may be positioned in enclosed space 112 and all air intakes and exhausts provided by rigid conventional duct work. Specifically, external air may be brought in through duct 122 covered by vent cap 123 and exhausted out roof duct work 113 covered by vent 114. Conditioned air may be routed through attic or overhead duct work 115 and into room 116 by vent 117 while air is being brought to heat pump 10 by duct work 124. It should be appreciated that combinations may also be used. E.g. a roof duct could be connected to flexible duct to provide fluid communication between heat pump 10 and the external air, while still allowing selective positioning of heat pump 10. Other combinations and permutations are also contemplated.

The preceding recitation is provided as an example of the preferred embodiments and is not meant to limit the nature of scope of the present invention or appended claims.

I claim:

1. A heat pump housing comprising:

a) a wall plate, said wall plate comprising a pair of lips; and b) a shell, said shell comprising a rearward edge, said rearward edge positioned between said pair of lips.

2. The housing of claim 1 further comprising a removable drain shelf.

3. The housing of claim 1 wherein said housing is formed from plastic.

4. The housing of claim 1 wherein said shell defines a side access aperture.

5. The housing of claim 4 wherein said shell defines a chamber, said chamber positioned behind said side access aperture.

6. The housing of claim 1 further comprising a blower, said blower positioned in said shell.

7. A heat pump housing comprising:

a) a generally planar wall plate, said wall plate comprising a pair of lips; and b) a shell, said shell comprising a rearward edge, said rearward edge positioned between said pair of lips.

8. The heat pump of claim 7 further comprising a support, said support positioned on said wall plate.

9. The heat pump of claim 7 further comprising a pair of supports, said supports extending from said wall plates for temporary positioning of said shell.

10. The heat pump of claim 7 further comprising a blower, said blower positioned in said shell.

11. The heat pump of claim 7 wherein said shell comprises a pair of shelves, each of said shelves defining a circular aperture.

12. A method of mounting a heat pump on a wall, said method comprising the steps of:

a) positioning a wall plate having a pair of lips on spaced wall studs, said wall plate including supports extending from the surface thereof;

b) resting a shell with a rearward edge on said supports; and c) attaching said shell to said wall plate by positioning the shell rearward edge between said pair of lips.

13. The method of claim 12 further comprising the step of sliding a shelf into said shell.

14. The method of claim 12 further comprising the step of providing electrical power to said heat pump.

15. The method of claim 12 further comprising the step of bringing outside air through the wall to said heat pump.

16. The method of claim 12 further comprising the step of positioning a side access panel over a utility chamber.

17. The method of claim 12 further comprising the step of positioning a side access panel over an electrical chamber.

* * * * *